US005320484A

United States Patent [19]

Charbonnel et al.

[11] Patent Number: 5,320,484

[45] Date of Patent: Jun. 14, 1994

[54] TURBOMACHINE STATOR HAVING A DOUBLE SKIN CASING INCLUDING MEANS FOR PREVENTING GAS FLOW LONGITUDINALLY THERETHROUGH

[75] Inventors: Jean-Louis Charbonnel, Le Mee sur Seine; Pierre Debeneix, St Sauveur/Ecole, both of France; Christopher C. Glynn, Hamilton, Ohio; Daniel J. Marey, Soisy s/Seine, France; Jean-Pierre A. J. Mourlan, Boissettes, France; Jacky S. Naudet, Bondoufle, France; Gerard Receveur, Nandy, France; Yann J. M. Rigaud, Pomponne, France; Roger C. Walker, Middletown, Ohio

[73] Assignee: General Electric Company, Cincinnati, Ohio

[21] Appl. No.: 55,068

[22] Filed: Apr. 29, 1993

[30] Foreign Application Priority Data

Aug. 26, 1992 [FR] France ..... 92 10278

[51] Int. Cl.[5] ..... F01D 9/00

[52] U.S. Cl. ..... 415/115; 415/134

[58] Field of Search ..... 415/115, 116, 134, 135

[56] References Cited

U.S. PATENT DOCUMENTS

| | | | |
|---|---|---|---|
| 3,376,017 | 4/1968 | Rizk et al. | 253/39 |
| 3,975,901 | 8/1976 | Hallinger et al. | 415/115 |
| 4,023,919 | 5/1977 | Patterson | 415/134 |
| 4,314,793 | 2/1982 | De Tolla et al. | 415/135 |
| 4,318,668 | 3/1982 | Chaplin et al. | 415/135 |
| 4,416,111 | 11/1983 | Lenahan et al. | 415/115 |
| 4,426,191 | 1/1984 | Brodell et al. | 415/189 |
| 4,431,373 | 2/1984 | Monsarrat | 415/189 |
| 4,541,775 | 9/1985 | Hovan | 415/115 |
| 4,720,236 | 1/1988 | Stevens | 415/136 |
| 4,807,433 | 2/1989 | Maclin et al. | 415/115 |
| 5,064,343 | 11/1991 | Mills | 415/115 |
| 5,100,291 | 3/1992 | Glover | 415/135 |

FOREIGN PATENT DOCUMENTS

| | | |
|---|---|---|
| 896166 | 2/1945 | France . |
| 2468738 | 10/1980 | France . |
| 2482661 | 5/1981 | France . |
| 2575221 | 11/1985 | France . |
| 2596115 | 3/1987 | France . |
| 961588 | 6/1964 | United Kingdom . |

*Primary Examiner*—John T. Kwon

*Attorney, Agent, or Firm*—Jerome C. Squillaro; Nathan D. Herkamp

[57] ABSTRACT

A turboshaft engine in which the stator comprises an outer casing surrounding a ring formed by a number of ring elements each having an apertured rib which spaces the element from the casing, the ribs dividing the space between the casing and the ring into separate compartments, and each rib having a sealing element disposed alongside it to cover the apertures and seal one compartment from the next. The casing and the ring are fixed together by virtue of bolts which have their axes inclined to the radial direction so that tightening the bolts causes the casing to press radially on the sealing elements at the same time as pressing them axially against the respective ribs.

3 Claims, 2 Drawing Sheets

TURBOMACHINE STATOR HAVING A DOUBLE SKIN CASING INCLUDING MEANS FOR PREVENTING GAS FLOW LONGITUDINALLY THERETHROUGH

BACKGROUND OF THE INVENTION

1. Field of the invention

The invention relates to a turboshaft engine having a stator equipped with means for preventing the longitudinal or axial flow of gas around the guide vane stages of the stator.

2. Summary of the prior art

The stator of many turboshaft engines comprises a double envelope formed by an outer casing and a ring which is surrounded by the casing and which is constituted by a plurality of interconnected elements to which the vanes of the guide stages are secured. The ring elements are screwed to the casing and are provided with radially-extending circumferential ribs which engage the casing to maintain the spacing between the ring and the casing. However, as these ribs are the cause of a substantial outward heat loss by virtue of their good thermal conductivity, they are provided with apertures so that they only touch the casing at circumferentially spaced positions. The drawback with this arrangement is that the volume between the ring and the outer casing becomes continuous, with the result that it becomes impossible to achieve fine adjustment of the clearance between the rotor blades and each ring element by blowing heating or cooling gas at different temperatures or rates into different sections of the volume between the casing and the ring in order to vary the thermal expansion of each ring element independently. Only an overall setting is possible, and this fails by far to provide the same degree of precision in reducing clearances to a minimum, so that the output of the engine is affected. Re-establishment of a seal at each rib is therefore desirable in order to prevent the axial flow of gas between the casing and the ring elements through the apertures of the ribs. Several solutions have been proposed in French Patents Nos. 2468738, 2482661 and 2575221, and in U.S. Pat. No. 4,314,793, but are generally fairly complicated. The aim of the invention is to provide a particularly simple solution to this problem.

SUMMARY OF THE INVENTION

According to the invention, there is provided a turboshaft engine including a stator comprising a casing, a plurality of ring elements surrounded by said casing, stages of guide vanes fixed to said ring elements, screw-threaded members fixing said ring elements to said casing, said ring elements being provided with ribs extending outwardly therefrom into contact with said casing to space said ring elements from said casing, said ribs each having apertures, such that only circumferentially spaced portions of the rib touch said casing, and a substantially radial bearing surface disposed inwardly of said apertures, and annular sealing elements for preventing the axial flow of gas between said ring elements and said casing through said apertures of said ribs, said sealing elements each comprising a circular soleplate and a web extending substantially radially inwards from said soleplate to engage frictionally said bearing surface of a respective one of said ribs, said web covering said apertures of said respective rib, and said casing being formed with a plurality of steps, one step for each of said sealing elements, each of said steps defining a first compression surface acting radially on said soleplate of the respective sealing element and a second compression surface acting axially on said soleplate to press said sealing element against the respective rib, said screw-threaded members being inclined with respect to the radial direction so that tightening said screw-threaded members causes said first and second compression surfaces of said casing steps to press on said sealing elements simultaneously. A preferred embodiment of the invention will now be described, by way of example, with reference to the accompanying drawings.

DESCRIPTION OF THE PREFERRED EMBODIMENT

Figure 1:
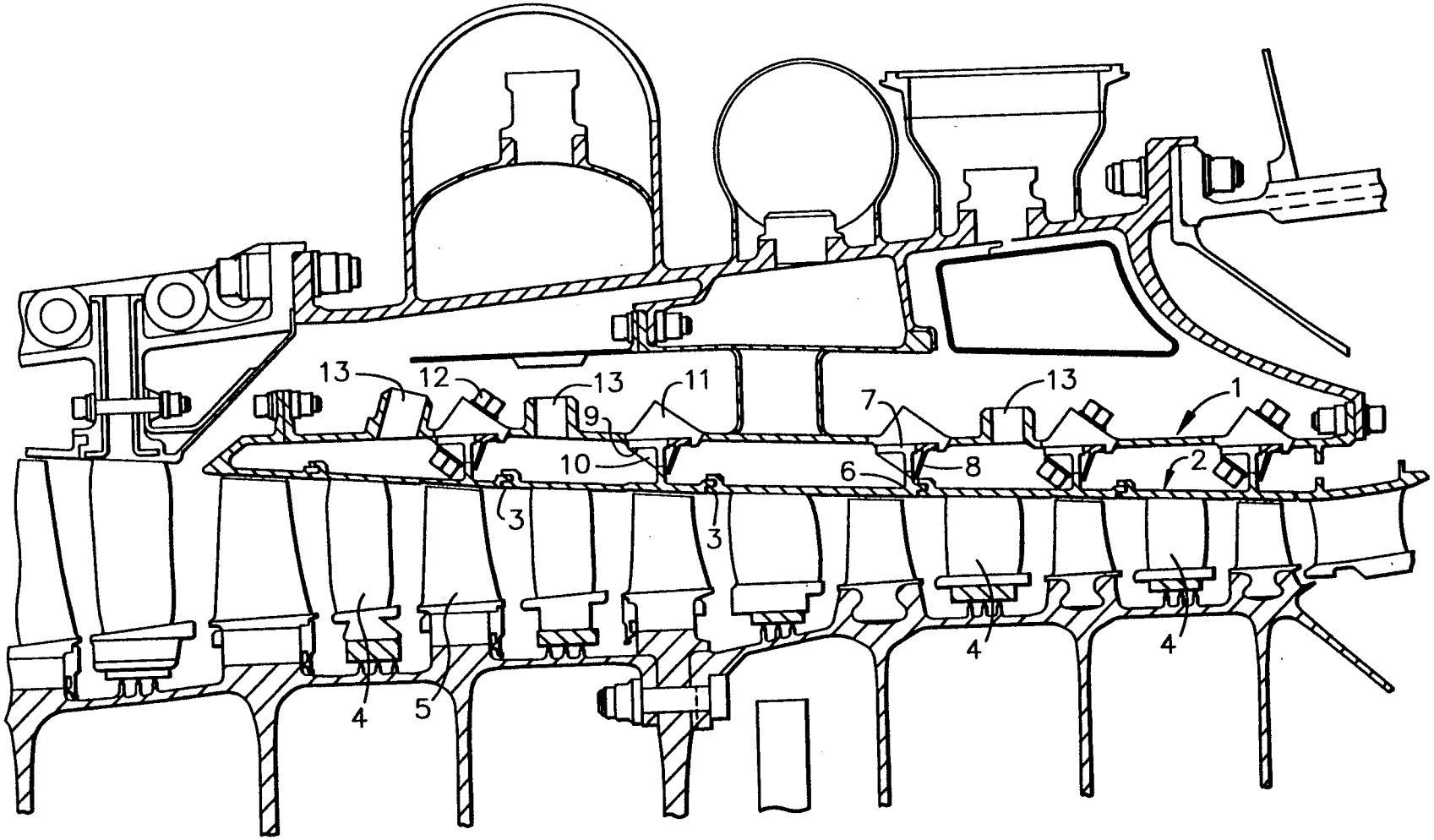
FIG. 1 is a diagrammatic axial section through part of a compressor in a turboshaft engine embodying the invention.

The stator of the compressor illustrated in FIG. 1 comprises a slightly frusto-conical outer casing 1, which may be formed by a number of interconnected parts, and a Plurality of frusto-conical ring elements 2 which are connected together end to end by interlocking joints 3 to form a single continuous ring surrounded by, and substantially parallel to the casing 1. Each ring element 2 carries a stage of fixed stator or guide vanes 4, and a stage of movable rotor blades 5 is disposed between successive stages of the fixed vanes 4.

Each ring element 2 is provided with a circumferentially extending rib 6 which projects radially outwards so that its outer edge 7 contacts the casing 1. The ribs 6 divide the volume between the casing 1 and the ring elements 2 into compartments, into each of which opens a device which supplies gas for regulating the clearance between the respective ring element 2 and the movable blade stage 5 surrounded thereby. These devices do not form part of the invention, and only the holes 13 which open through the casing 1 into the different compartments are shown.

Figure 3:
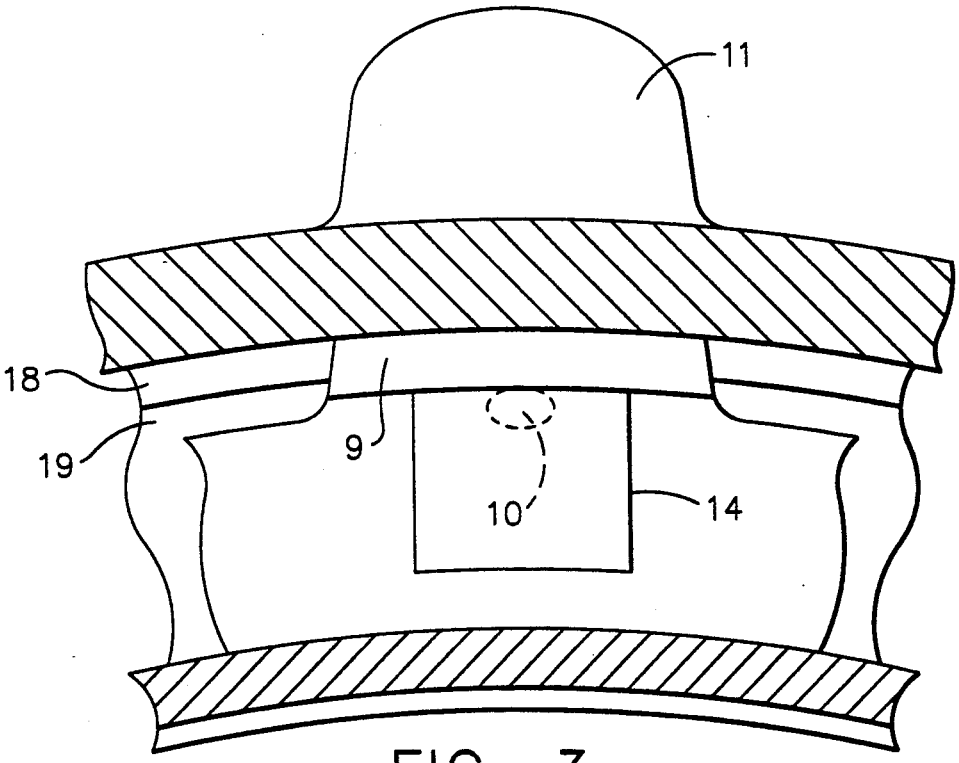
FIG. 3 is an axial view of the components as shown in FIG. 2.

Each rib 6 is cut away over large parts of its circumference to form apertures 14 (best seen in FIG. 3) which extend over most of the radial height of the ribs 6 up to the casing 1, so that the ribs touch the casing 1 only through the outer edges 7 of the relatively small portions of the ribs between the apertures, thereby extensively limiting the heat transmitted to the casing 1 by the ribs 6. Associated with each rib 6 is a sealing element 8 (described below in more detail) which covers the apertures 14 and serves to maintain the compartments divided by the rib separate from each other.

At its outer edge 7 each rib portion between the apertures 14 is provided with an axially projecting flange 9 having a block 10 formed between it and the rib 6 at a position opposite another block 11 formed by an outward thickening of the casing 1. The blocks 10 and 11 have aligned holes extending through them for accommodating bolts 12 which serve to connect the casing 1 and the ring elements 2 rigidly together.

Figure 2:
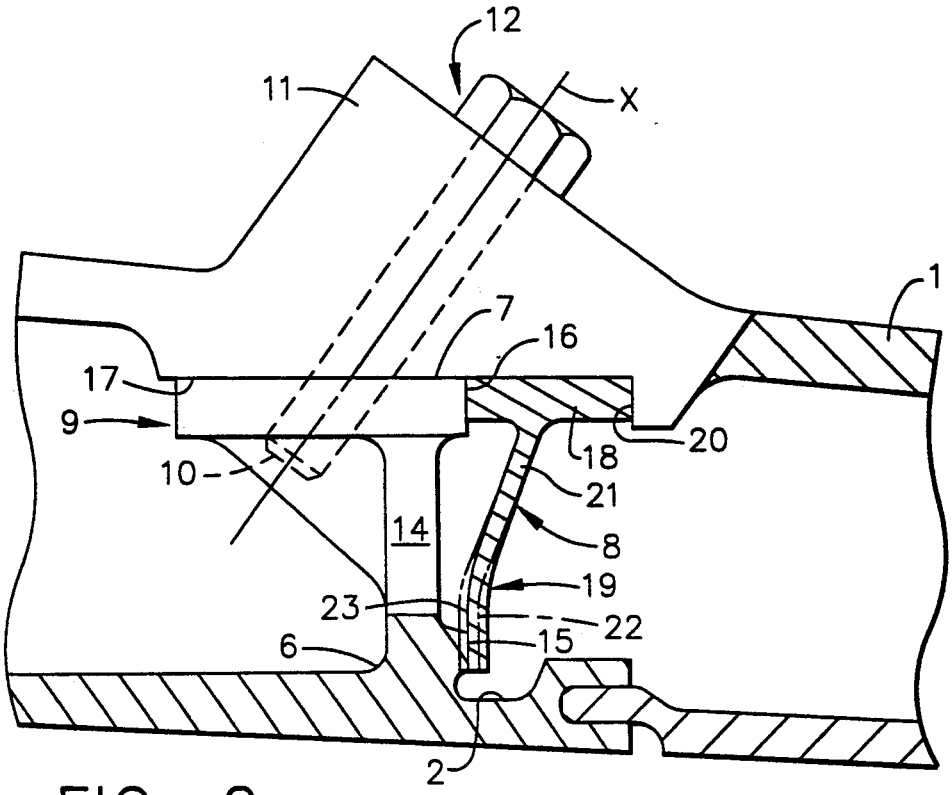
FIG. 2 is a view of part of FIG. 1 to a larger scale showing the arrangement in accordance with the invention in more detail.

As can be seen in FIG. 2, each rib 6 has a circumferentially extending bearing surface 15 situated in a radial plane and disposed radially inwards from the apertures 14, and each of the flanges 9 has a further bearing surface 16 lying in the same radial plane, the bearing surfaces 15,16 facing towards the associated sealing element 8.

Each sealing element 8 is a continuous ring comprising an outer circular soleplate 18 which abuts the bearing surfaces 16 of the associated rib flanges 9, and a web 19 which extends inwardly from the soleplate 18. The web 19 has an outer portion 21 which is inclined towards the associated rib 6, and a radial inner end portion 22 having a bearing surface 23 which abuts the bearing surface 15 of the rib 6. The web 19 is slightly resilient and when the sealing element 8 is unstressed the inner end portion 22 protrudes axially beyond the plane of one end of the soleplate 18 as shown by the dashed lines in FIG. 2.

In the region of each rib 6 and associated sealing element 8 the interior of the casing 1 is formed with a step defining an axially extending circular surface 17 which acts radially on the outer surfaces of the flanges 9 and the soleplate 18, and a radially extending surface 20 which acts axially on the soleplate 18 to press it towards the rib 6 and against the bearing surfaces 16.

When the stator is assembled, the tightening of the bolts 12 attaching a particular ring element 2 to the casing 1 brings about both an axial displacement of the associated sealing element 8 towards the rib 6 as a result of the step surface 20 acting axially on the soleplate 18, causing the web 19 to yield resiliently when the surfaces 15 and 23 come into contact with each other, and a radial displacement as a result of the compression exerted radially on the soleplate 18 by the step surface 17. A situation is thus reached where the sealing element 8 bears firmly against the surfaces 15 and 16 of the rib 6 and against the surfaces 17 and 20 of the casing 1. The surfaces 15,16,17 and 20, as well as the surfaces of the sealing element 8 which bear upon them, are slightly roughened, for example by a turning operation, to prevent any significant flow of gas between the compartments.

The axis X of the bolts 12 may be inclined in the longitudinal or axial direction at an angle of about 40° or 50° depending on whether axial or radial compression is to be favoured, which is a matter particular to each embodiment. It is of course possible to employ other angles of inclination.

The fitting of the sealing elements 8 raises no particular difficulties, as they may be introduced through the wider mouth of the frusto-conical casing 1 prior to mounting and bolting the ring elements 2 in position.

We claim:

1. A turboshaft engine including a stator comprising a casing, a plurality of ring elements surrounded by said casing, stages of guide vanes fixed to said ring elements, screw-threaded members fixing said ring elements to said casing, said ring elements being provided with ribs extending outwardly therefrom into contact with said casing to space said ring elements from said casing, said ribs each having apertures, such that only circumferentially spaced portions of the rib touch said casing, and a substantially radial bearing surface disposed inwardly of said apertures, and annular sealing elements for preventing the axial flow of gas between said ring elements and said casing through said apertures of said ribs, said sealing elements each comprising a circular soleplate and a web extending substantially radially inwards from said soleplate to engage frictionally said bearing surface of a respective one of said ribs, said web covering said apertures of said respective rib, and said casing being formed with a plurality of steps, one step for each of said sealing elements, each of said steps defining a first compression surface acting radially on said soleplate of the respective sealing element and a second compression surface acting axially on said soleplate to press said sealing element against the respective rib, said screw-threaded members being inclined with respect to the radial direction so that tightening said screw-threaded members causes said first and second compression surfaces of said casing steps to press on said sealing elements simultaneously.

2. A turboshaft engine according to claim 1, wherein the inclination of said screw-threaded members is from 40° to 50° relative to the radial direction.

3. A turboshaft engine according to claim 1, wherein said web of each sealing element has a substantially radial surface which is pressed against said bearing surface of the respective rib, said radial surface of said web protruding axially beyond the soleplate of the sealing element when said sealing element is unstressed.

* * * * *